United States Patent [19]

Washington et al.

[11] Patent Number: 5,048,773

[45] Date of Patent: Sep. 17, 1991

[54] CURVED GRID FIN

[75] Inventors: William D. Washington, Arab; Thomas L. Killough; Pamela F. Booth, both of Huntsville; Billy J. Walker, Madison, all of Ala.

[73] Assignee: The United States of America as represented by the Secretary of the Army, Washington, D.C.

[21] Appl. No.: 534,995

[22] Filed: Jun. 8, 1990

[51] Int. Cl.[5] ..... F42B 10/14

[52] U.S. Cl. ..... 244/3.28; 244/113; 102/386

[58] Field of Search ..... 244/3.23, 3.24, 3.27, 244/3.28, 3.29, 3.3, 46, 49, 12.6, 110 D, 113; 102/388, 386, 385

[56] References Cited

U.S. PATENT DOCUMENTS

| | | | |
|---|---|---|---|
| 252,299 | 5/1943 | Dornier | 244/113 |
| 3,047,259 | 7/1962 | Tatnall et al. | 244/113 |
| 4,165,849 | 8/1979 | Fox | 244/113 |

FOREIGN PATENT DOCUMENTS

| | | | |
|---|---|---|---|
| 167904 | 8/1954 | Austria | 244/113 |
| 699067 | 11/1940 | Fed. Rep. of Germany | 244/113 |
| 718322 | 3/1942 | Fed. Rep. of Germany | 244/113 |
| 368727 | 3/1939 | Italy | 244/113 |

*Primary Examiner*—Michael J. Carone

*Attorney, Agent, or Firm*—Freddie M. Bush; James T. Deaton; Howard G. Garner

[57] ABSTRACT

A curved grid fin that is constructed of strips of thin gauge metal such as steel honeycomb secured together in a grid pattern with the honeycomb structure enclosed around a periphery thereof by a thin support structure that is secured thereto in a conventional manner and with a base structure secured to the thin support structure to provide a fin that is designed to be mounted on a missile to provide a fin structure that can control or guide a missile as well as provide a breaking or deceleration means for control of a missile or payload.

11 Claims, 2 Drawing Sheets

CURVED GRID FIN

DEDICATORY CLAUSE

The invention described herein may be manufactured, used, and licensed by or for the Government for governmental purposes without the payment to us of any royalties thereon.

BACKGROUND OF THE INVENTION

In the past, fins have been used to stabilize and control missiles and aircrafts. Conventional fins are planar, constructed of solids or non porous materials and are mounted on a missile body in such a way as to be aligned with the velocity flow thereby. Conventional fins generate lift or control forces when rotated out of alignment with the air flow thereover or when set at incidence with air flow. With the above prior art fin arrangement, there are many limitations and therefore there is a need for a fin that has different characteristics and capabilities for use to control missiles or aircraft.

SUMMARY OF THE INVENTION

Accordingly, it is an object of this invention to provide a grid fin that is non planar and has open or porous structure.

Another object of this invention is to provide a curved grid fin that is contoured to conform to the outer shape of a missile body to enable the fin to be stored within a portion of the missile body.

Still another object of this invention is to provide a fin that has the ability to develop lift for stability when set at incidence and aligned perpendicular to the air flow direction.

A still further object of this invention is to provide a curved grid fin that can be used as a drag brake on a missile.

Other objects and advantages of this invention will be obvious to those skilled in this art.

In accordance with this invention, a curved, grid fin is provided that is used as a light weight, easily storable aerodynamic control device for decelerating and stabilizing incoming missile payload and then controlling the payload while maneuvering over the battlefield to look for targets. The curved grid fin is porous and has very small hinge moments throughout the mach number range that the missile is subjected to.

DESCRIPTION OF THE PREFERRED EMBODIMENT

Figure 1:
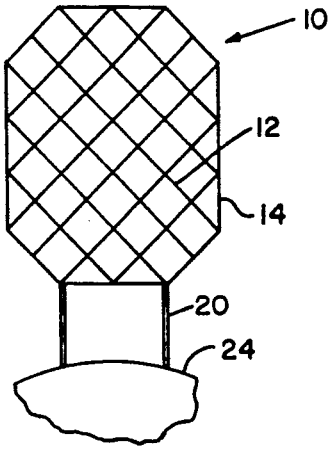
FIG. 1 is a front view of the curved grid fin in accordance with this invention, mounted on a missile body that is partially cut away.
Figure 2:
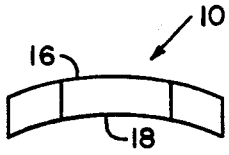
FIG. 2 is a top view of the curved grid fin shown in FIG. 1 in accordance with this invention.

Referring now to the Drawings, a curved grid fin 10 includes a honeycomb structure 12 with a support frame structure 14 as a continuous piece around the periphery of honeycomb structure 12. Support structure 14 and honeycomb structure 12 are preferably made of thin gauge metal such as steel and are secured together in conventional manner such as by welding.

Figure 3:
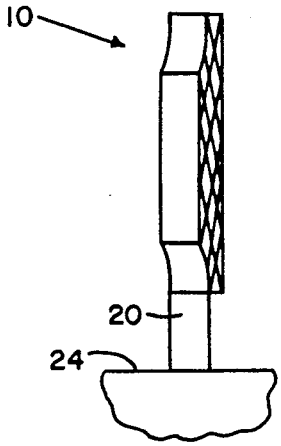
FIG. 3 is a side view of the curved grid fin shown in FIG. 1 in accordance with this invention and mounted on a missile body that is partially cut away.
Figure 4:
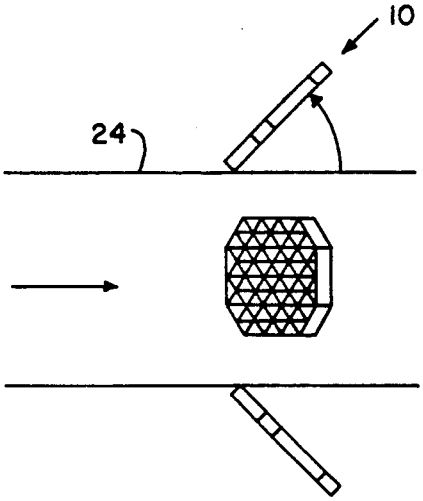
FIG. 4 is a schematic illustration of a side view of a missile with four grid fins mounted therearound and with the grid fins in a swept backward drag brake position.
Figure 5:
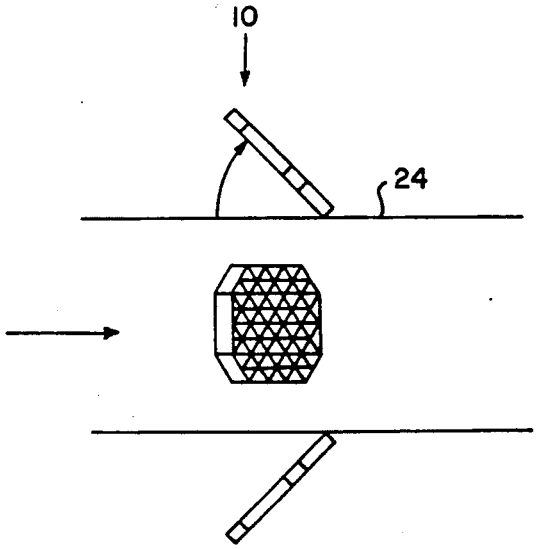
FIG. 5 is a side view of a missile with four grid fins positioned therearound and in a swept forward drag brake position.
Figure 6:
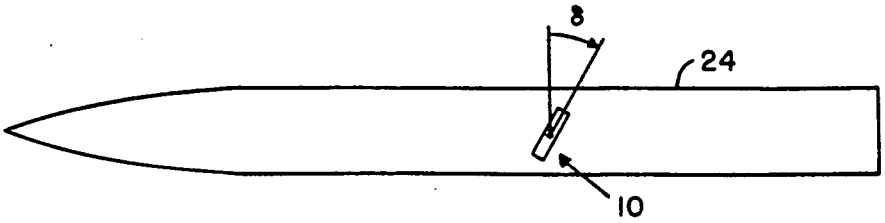
FIG. 6 is a side view of a missile with a grid fin actuated into a control deflection position.

Honeycomb structure 12 has curved sides 16 and 18 that are curved to be that of the curvature of a missile body structure of the particular missile that curved grid fins 10 are to be mounted on. Curved grid fin 10 has base support structure 20 that is secured in a conventional manner to outer frame structure 14 and has a bottom portion 22 of a U shape (see FIG. 7) that is used for securing curved grid fin 10 to the actuator structure of the missile on which curved grid fin 10 is mounted. Curved grid fin 10 is designed to be mounted on a missile structure such as missile structure 24. Curved grid fin 10 is designed to lie flat along the missile body in an indented portion of the missile body such that the trailing edge or leading edge of the curved grid fin is flush with the missile outside diameter. After the missile is deployed and reaches a point over a target, curved grid fin 10 is popped up away from the missile body in which it is mounted to an angle of plus or minus 45°. Curved grid fin 10 is popped up in a conventional manner by its control mount located inside missile 24. As illustrated in FIGS. 4 and 5, curved grid fins 10 are utilized in these arrangements by having four of the curved grid fins equally spaced around the periphery of missile 24. The plus or minus 45° is the highest angle of drag and a smaller angle can be used if desired for less effect. With the curved grid fins deployed to the desired number of degrees relative to missile body 24, the curved grid fins act as a drag brake, and the many honeycombed slots contribute both skin friction and wave drag. Once the missile has decelerated to the desired terminal velocity, curved grid fins 10 can then be rotated additional degrees so they are perpendicular to the missile body such as illustrated in FIG. 3. In this perpendicular position of the curved grid fins relative to the missile body, the curved grid fins can then be used as a control device by turning the grid fins a predetermined angle delta relative to the missile as illustrated in FIG. 6 and act as a guiding means for guiding the missile to a target.

In operation, curved grid fins 10 are deployed in flight as the payload of the missile is being separated from the missile proper and typically at supersonic speeds. With the curved grid fins swept back or forward at an angle of about 45° with the longitudinal axis of the missile body, maximum drag is produced for deceleration of the payload. After the payload has been decelerated to a sufficiently low speed, the angle of control fins 10 is then adjusted by utilizing the actuator to which they are connected to adjust the control fins to a position perpendicular to the missile body and in a position where air flows freely through the slots of the fin to provide stability and control during maneuvers over the battlefield. If the payload needs to be further guided, control fins 10 are adjusted into an angular position delta such as illustrated in FIG. 6 for guiding the payload to the desired position. As will be appreciated, the curved grid fin as disclosed herein can be used as a light weight, easily storable aerodynamic control device for decelerating and stabilizing an incoming missile payload, and then controlling the payload while maneuvering over the battlefield to look for targets. Its' advantages are in greater structural integrity for a given weight which results in a weight savings and therefore increased range, more efficient storage which minimizes launcher size requirements, and in very small hinge moments that results in reduced control actuator requirements.

Figure 7:
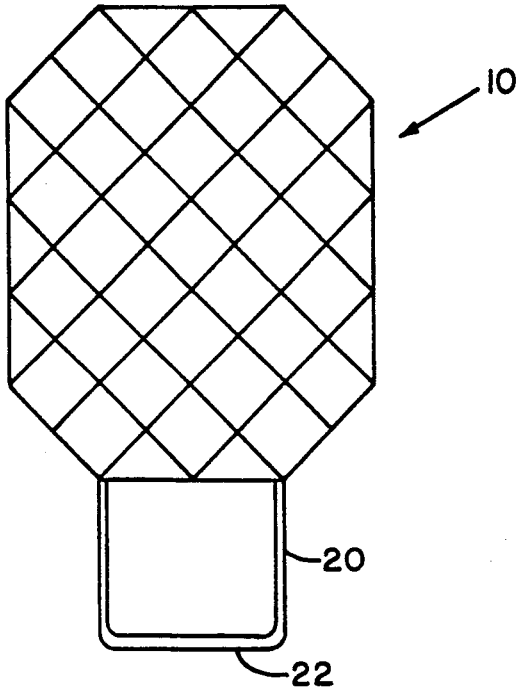
FIGS. 7 and 8 illustrate a typical curved grid fin with the relative dimensions of the curved grid fin noted.
Figure 8:
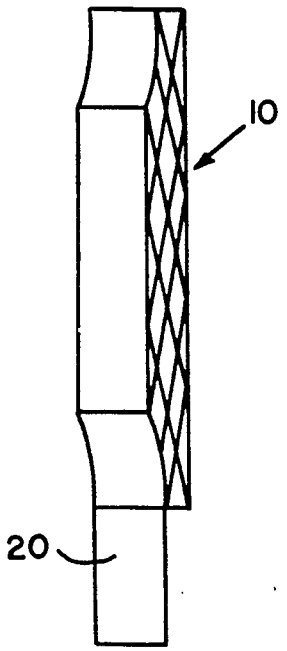

As illustrated in FIGS. 7 and 8, the ratio of the various sizes of the parts in control grid fin 10 that are acceptable in a control fin as disclosed herein are illustrated as an acceptable example. It should also be noted that the 8 sided grid fin structure is an acceptable shape for a grid fin of the type used in this invention.

We claim:

1. A grid fin for use with a guided missile, comprising:

(a) a honeycomb porous core structure comprised of thin gauge material for permitting air to flow therethrough substantially unrestricted when said grid fin is transverse of said air flow;

(b) a support structure for supporting said core structure; and (c) means for mounting said support structure on a control mechanism of said missile for relative movement between said missile and said support structure.

2. A grid fin as set forth in claim 1, wherein said grid fin has inner and outer curved surfaces that are curved to the same curvature of the outer periphery of a missile upon which the grid fin is mounted.

3. A grid fin as set forth in claim 1, wherein said means at one side of said support structure is U shaped with the base of the U being adapted to be secured to said control mechanism, and projections from the base of the U shaped structure being secured to an outer surface of said support structure.

4. A grid fin as set forth in claim 1, wherein said grid fin has an outer shape that is made up of eight straight edges around the periphery of the grid fin.

5. A grid fin as set forth in claim 4, wherein two of said straight edges are longer in length than the other six straight edges.

6. A guided missile as set forth in claim 1, wherein said thin gauge material comprising said honeycomb porous core structure comprises thin flat metal strips.

7. A guided missile as set forth in claim 1, wherein said thin gauge material of said honeycomb porous core structure comprises thin strips of steel.

8. A guided missile having a plurality of symmetrically disposed aerodynamic control grid fins for decelerating and stabilizing said missile, each of said grid fins comprising:

(a) a honeycomb porous core structure comprised of thin gauge material for permitting air to flow therethrough substantially unrestricted when said grid fin is transverse of said air flow;

(b) a support structure for supporting said core structure; and (c) means for mounting said support structure on a control mechanism of said missile for controlled movement relative to said missile for decelerating and stabilizing said missile during flight.

9. A guided missile as set forth in claim 8, wherein each of said grid fins has inner and outer curved surfaces, curved to the same curvature as the outer periphery of said missile.

10. A guided missile as set forth in claim 8, wherein said thin gauge material comprising said honeycomb porous core structure are thin flat metal strips.

11. A guided missile as set forth in claim 8 wherein said thin gauge material of said honeycomb porous core structure comprises thin strips of steel.

* * * * *